US006425521B1

(12) United States Patent
Cooper

(10) Patent No.: US 6,425,521 B1
(45) Date of Patent: Jul. 30, 2002

(54) MAILBOX INDICATOR FLAG

(76) Inventor: Gary E. Cooper, 1660 Amanda La., Cantonment, FL (US) 32533

( * ) Notice: Subject to any disclaimer, the term of this patent is extended or adjusted under 35 U.S.C. 154(b) by 0 days.

(21) Appl. No.: 09/591,241

(22) Filed: Jun. 9, 2000

Related U.S. Application Data

(60) Provisional application No. 60/138,807, filed on Jun. 14, 1999, and provisional application No. 60/161,052, filed on Oct. 25, 1999.

(51) Int. Cl.[7] ..... B65D 91/00
(52) U.S. Cl. ..... 232/34; 232/35
(58) Field of Search ..... 232/34, 35, 17, 232/45; 116/204; 16/320, DIG. 14

(56) References Cited

U.S. PATENT DOCUMENTS

| | | | | | |
|---|---|---|---|---|---|
| 1,010,519 | A | * | 12/1911 | Pederson | 232/34 |
| 1,504,514 | A | * | 8/1924 | Ryther | 232/34 |
| 2,730,298 | A | * | 1/1956 | Haserodt | 232/35 |
| 2,808,982 | A | * | 10/1957 | Armstrong | 232/35 |
| 3,343,784 | A | * | 9/1967 | Waldhaus et al. | 232/35 |
| 4,316,575 | A | * | 2/1982 | VanDarwarka | 232/35 |
| 4,344,559 | A | * | 8/1982 | Widham | 232/35 |
| 4,382,542 | A | * | 5/1983 | Farris | 232/35 |
| 4,492,335 | A | * | 1/1985 | Davis | 232/35 |
| 4,655,390 | A | * | 4/1987 | Martin | 232/35 |
| 4,702,411 | A | * | 10/1987 | Yager | 232/35 |
| 4,708,286 | A | * | 11/1987 | Norris | 232/35 |
| 4,840,307 | A | * | 6/1989 | Hartman | 232/35 |
| 5,235,933 | A | * | 8/1993 | Pare et al. | 116/204 |
| 5,489,064 | A | * | 2/1996 | Shively | 232/34 |
| 5,524,818 | A | * | 6/1996 | Patry et al. | 232/35 |
| 6,155,482 | A | * | 12/2000 | Perry | 232/35 |

* cited by examiner

*Primary Examiner*—B. Dayoan
*Assistant Examiner*—William L. Miller
(74) *Attorney, Agent, or Firm*—Peter Loffler

(57) ABSTRACT

An indicator flag for attachment to a mailbox for indicating the presence of mail therein uses a generally horizontally disposed flag member that is rotatably attached to the door of the mailbox and that rotates between a first position wherein the flag member is generally flush against the mailbox door, indicating an absence of mail for pickup, and a second position wherein the flag member extends generally horizontally outwardly from the door, indicating the presence of mail therein for pickup. A mail carrier can easily rotate the flag member back to the first position with the same motion used to open the mailbox door.

49 Claims, 11 Drawing Sheets

MAILBOX INDICATOR FLAG

This application takes the benefit of U.S. provision application No. 60/138,807 filed on Jun. 14, 1999, and U.S. provisional application No. 60/161,052 filed on Oct. 25, 1999.

BACKGROUND OF THE INVENTION

1. Field of the Invention

The present invention relates to a mailbox for receipt of mail therein, the mailbox having an indicator flag mounted on the door and rotatable outwardly from the door.

2. Background of the Prior Art

Current mailboxes have a standard indicator flag mounted on the side of the mailbox with the flag in a normal generally horizontal position running from proximate the front of the mailbox toward the back thereof, and thereafter the flag is raised to a vertical position to indicate the presence of mail therein for pickup by the mail carrier. While this system has been in use for a long time, it is not without its drawbacks. The mail carrier must open the door of the mailbox to retrieve the mail therein and then must rotate the indicator flag about a horizontal axis back down to its normal generally horizontal position. This second movement of indicator flag lowering, in addition to being time-consuming, requires the mail carrier to stretch out and rotate the flag to its down position. Such stretching and rotating, repeated dozens of times throughout each work day, can lead to muscle strain and other physical maladies.

Additionally, many such indicator flags are difficult to see by the mail carrier which can result in missed pickups. This is especially true when the indicator flag is attached to a mailbox that is housed within a large structure such as a brick mailbox enclosure and the raised flag does not clear the top of the structure or when bushes and other vegetation obscure the line of sight of the mail carrier to the indicator flag.

Therefore, there is a need in the art for a mailbox indicator flag that addresses the aforementioned needs in the art. Such an indicator flag must not be time-consuming to the mail carrier, must not subject the mail carrier to undue stretching and rotating of body parts, and must be relatively easy to see by the mail carrier even when the mailbox is in less than an ideal visual location. Ideally, such an indicator flag is of relatively simple design and construction.

SUMMARY OF THE INVENTION

The mailbox indicator flag of the present invention addresses the aforementioned needs in the art. The mailbox indicator flag eliminates the need for the mail carrier to stretch out and rotate the flag to its normal position thereby saving the time and reducing the potential for muscle strain. The mailbox indicator flag is relatively easy to see even when used with mailboxes that are part of a larger structure or mailboxes that are located proximate substantial vegetation growth. The mailbox indicator flag is of relatively simple design and construction.

The mailbox indicator flag of the present invention is comprised of a typical mailbox having a hollow interior with a door attached to the mailbox for gaining access to the interior. A generally horizontally disposed flag member is rotatably attached to the door and is capable of rotating between a first position wherein the flag member is generally flush against the door and a second position wherein the flag member extends outwardly from the door generally normally with respect to the face of the door. The flag member is attached to the door by any appropriate hinging element such as a limit hinge, and if a limit hinge is used, it may be spring-loaded. The flag member may be attached to the door directly or may be attached to the door via a base plate wherein the flag member is attached to the base plate and the base plate is attached to the door by any appropriate means. The flag member may be capable of rotating to a third position, which third position is located on a plane that is generally similar to the plane whenever the flag member is in the first position. An indented portion may be disposed on the door, the indented portion receiving the flag member (and its attendant base plate, if used) whenever the flag member is in the first position. A stop may be attached or be a part of the door, the base plate, or the hinging element for preventing further extension of the flag member beyond the second position. A magnet may be attached to either the flag member or the door (or base plate, if used) for holding the flag member against the door or base plate whenever the flag member is in the first position. If the flag member holds the magnet, and the door (or base plate) is made from a nonmagnetic material then a magnetically sensitive portion is attached to the receiving unit (door or base plate) (or vice versa) for magnetically coupling the flag with the door or base plate. A magnet may also be attached to either the flag member or the stop for holding the flag member against the stop whenever the flag member is in the second position. If the flag member holds the magnet and the stop is made from a nonmagnetic material (or vice versa), then a magnetically sensitive portion is attached to the stop (or vice versa) for magnetically coupling to the magnet on the flag member or stop.

BRIEF DESCRIPTION OF THE DRAWINGS

Similar reference numerals refer to similar parts throughout the several views of the drawings.

DESCRIPTION OF THE PREFERRED EMBODIMENT

Figure 1:
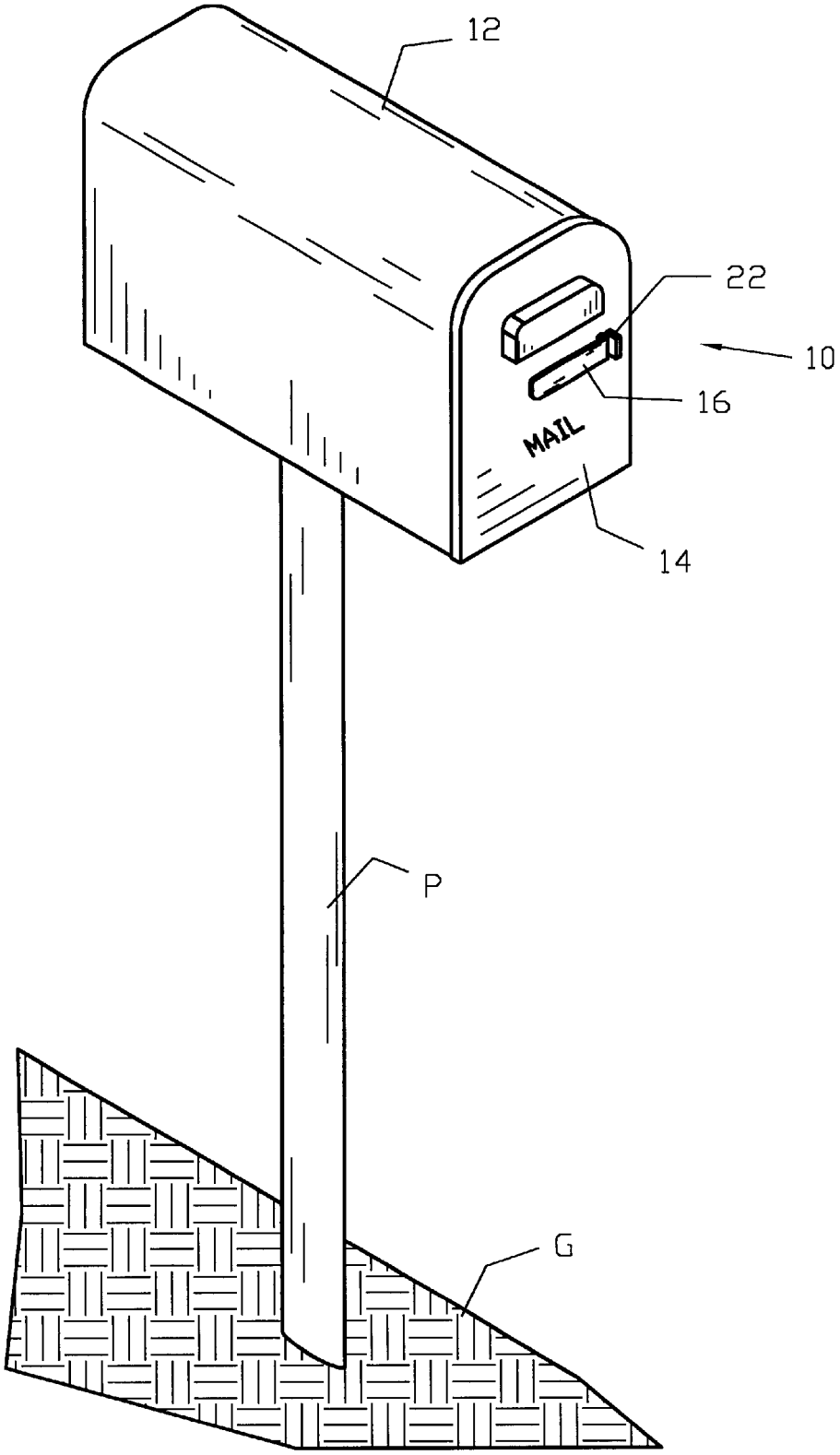
FIG. 1 is a perspective view of the receptacle with indicator flag of the present invention with the flag member in the first position.
Figure 2:
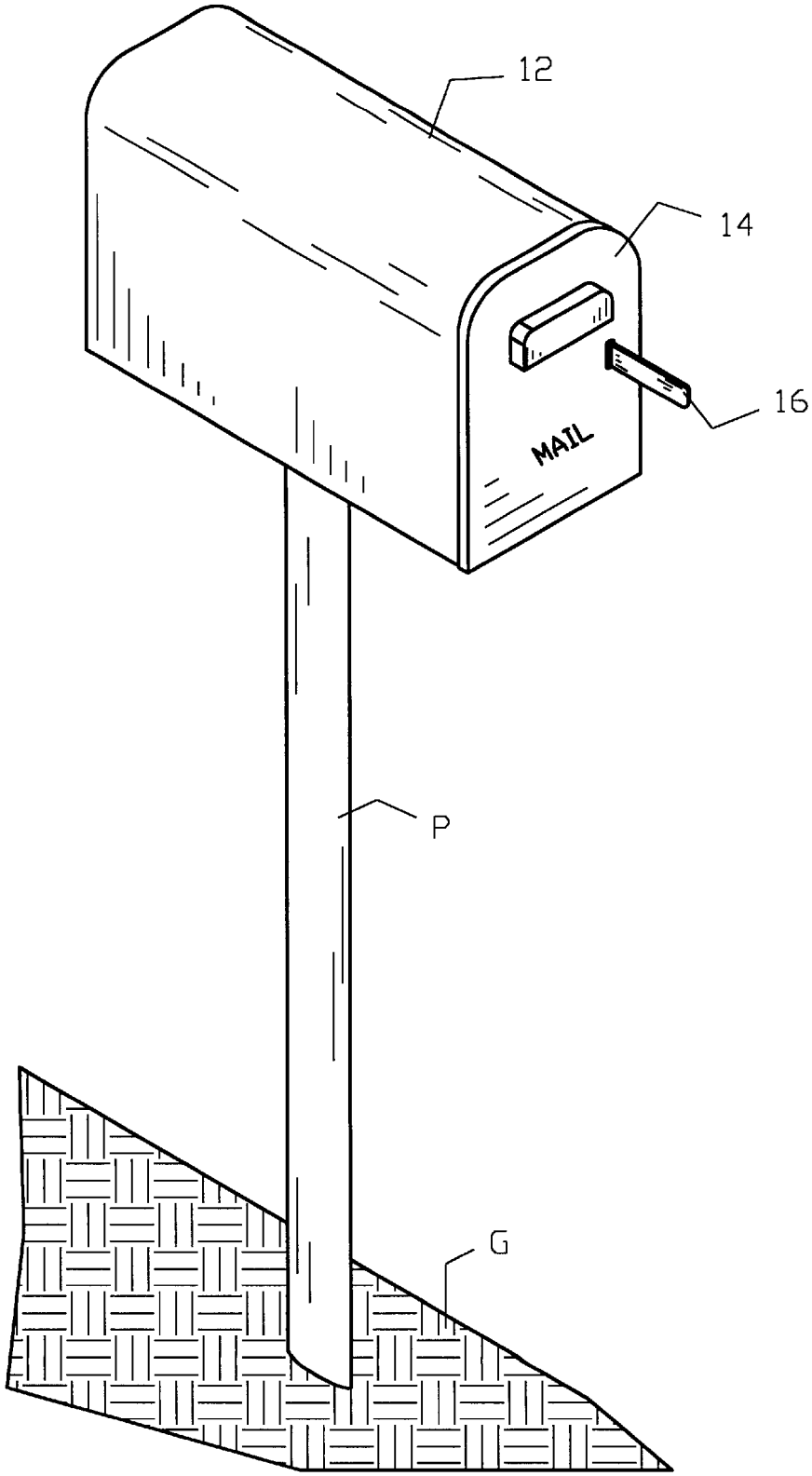
FIG. 2 is a perspective view of the receptacle with indicator flag of the present invention with the flag member in the second position.
Figure 3:
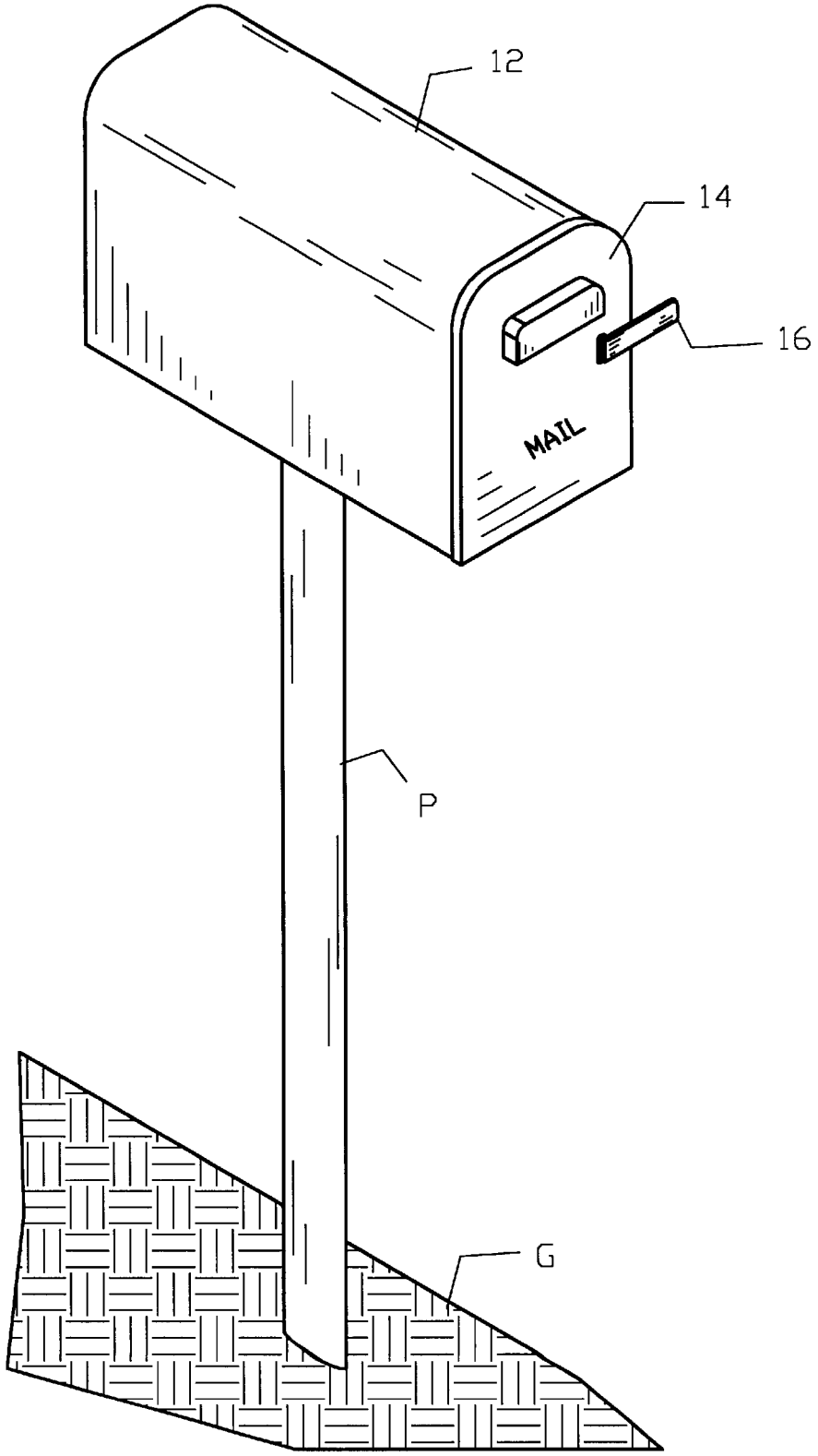
FIG. 3 is a perspective view of the receptacle with indicator flag of the present invention with the flag member in the alternate third position.
Figure 4:
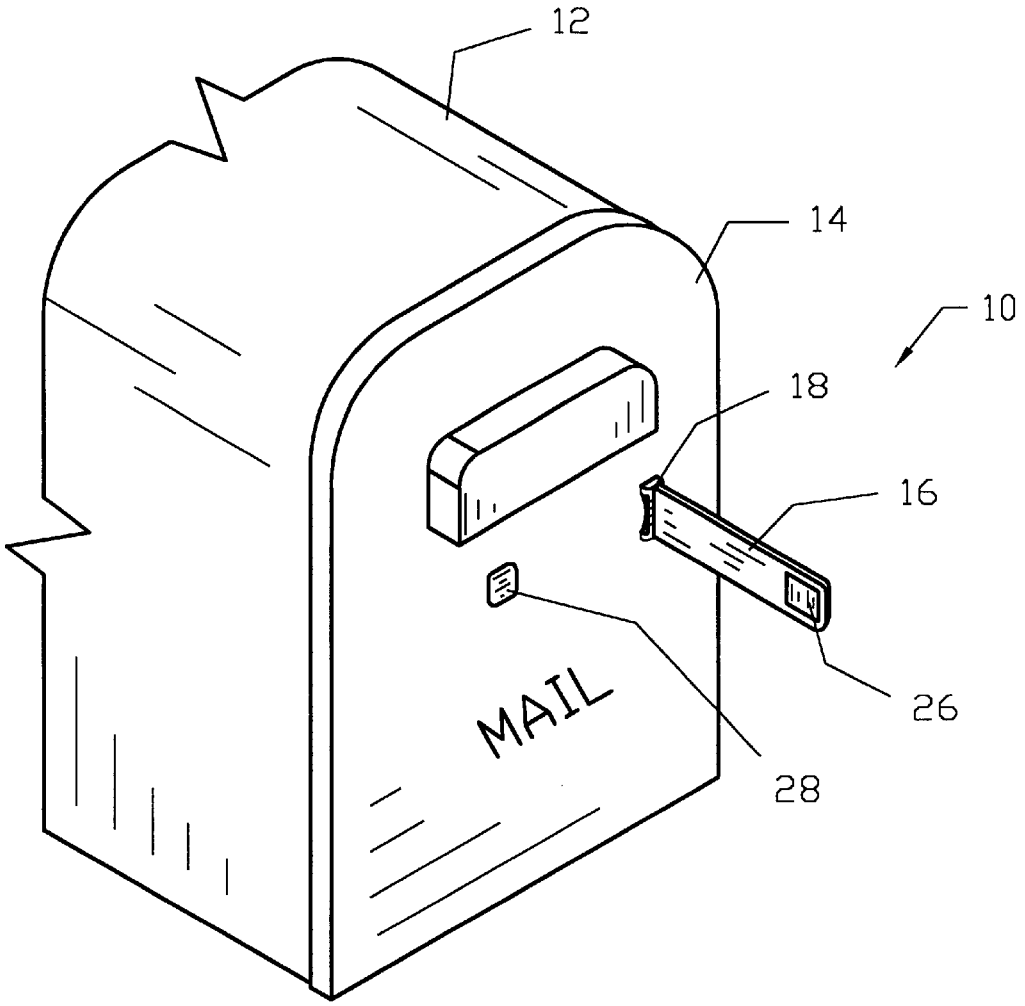
FIG. 4 is a close-up view of the flag member attached to the door of the receptacle.
Figure 5:
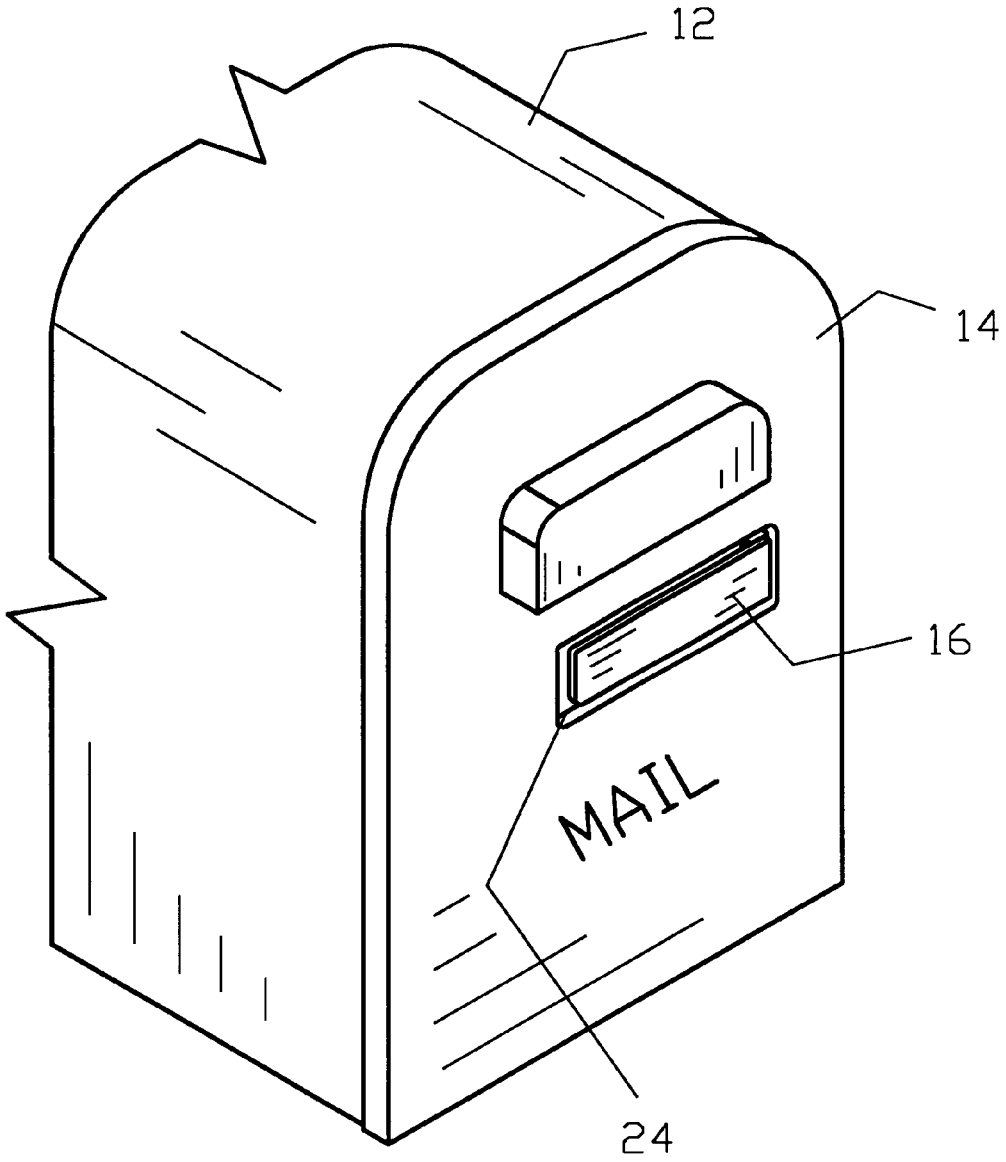
FIG. 5 is a close-up view of the flag member attached to the door of the receptacle with the door having an indented portion, the flag member in the first position.
Figure 6:
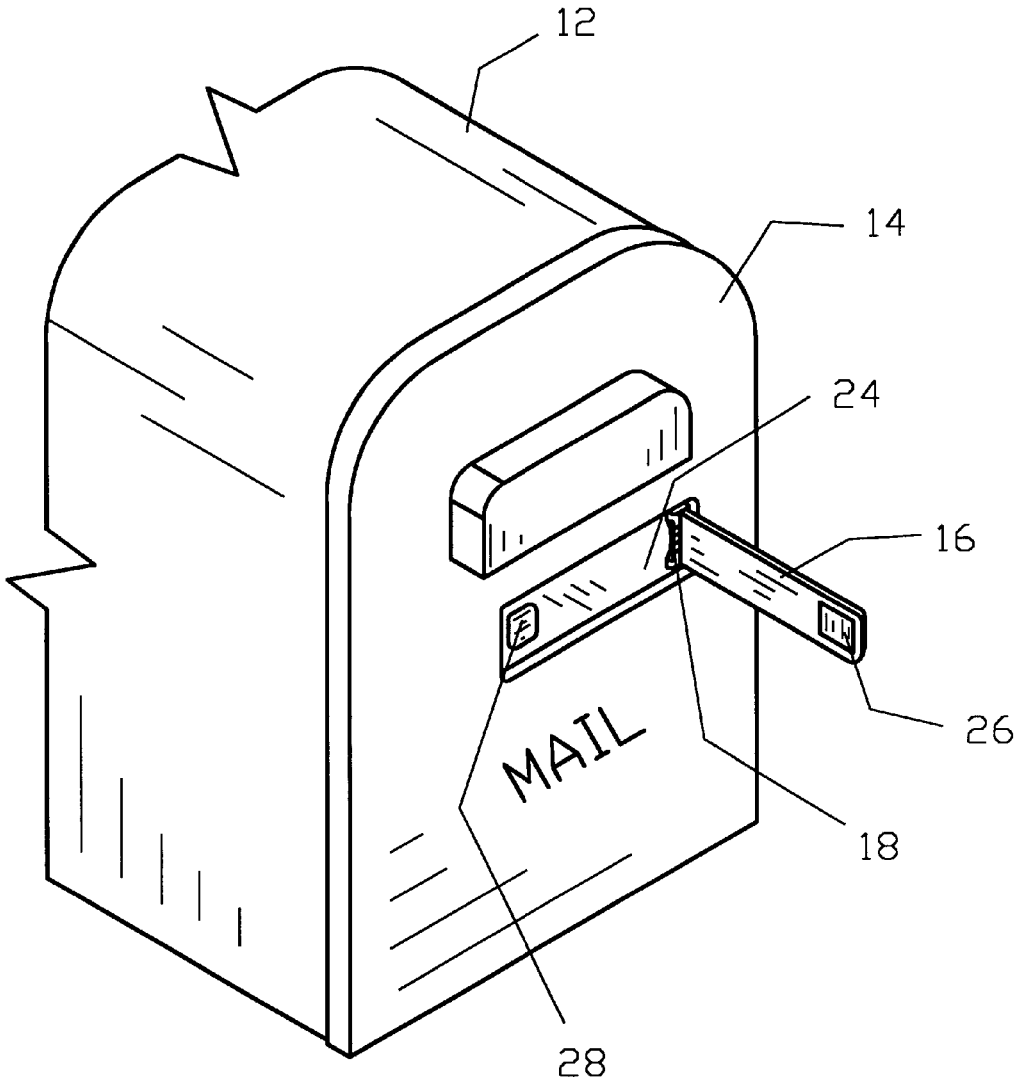
FIG. 6 is a close-up view of the flag member attached to the door of the receptacle with the door having an indented portion, the flag member in the second position.
Figure 7:
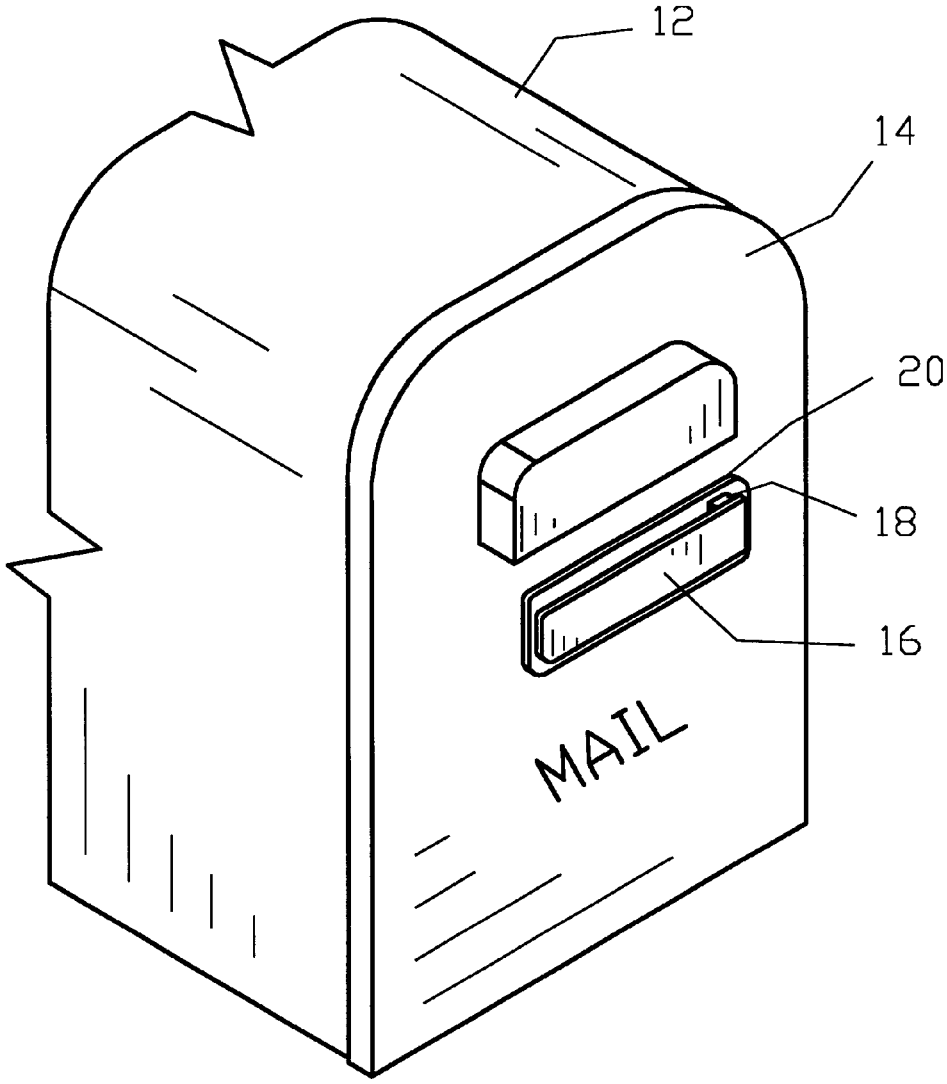
FIG. 7 is a close-up view of the flag member attached to the door of the receptacle with the flag member attached to the door by a base plate and in the first position.
Figure 8:
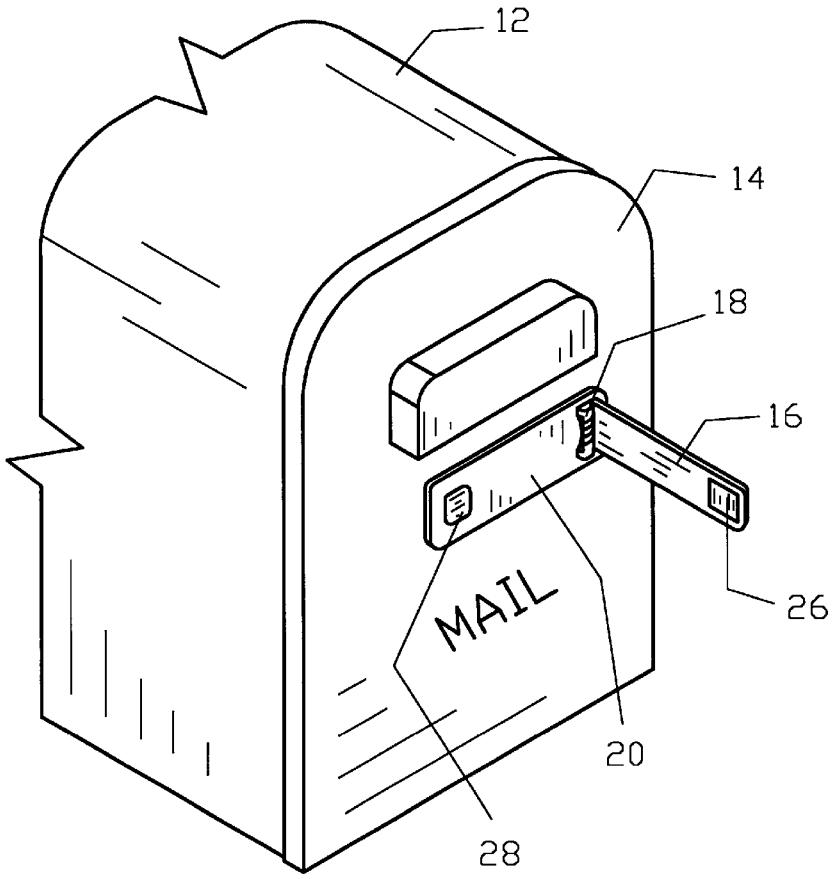
FIG. 8 is a close-up view of the flag member attached to the door of the receptacle with the flag member attached to the door by a base plate and in the second position.
Figure 9:
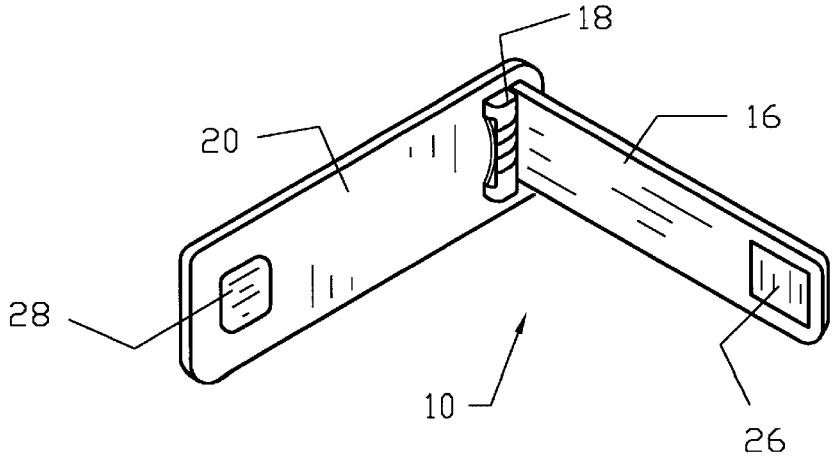
FIG. 9 is a close-up view of the flag member attached to the base plate wherein the hinging element acts as a rotational stop.
Figure 10:
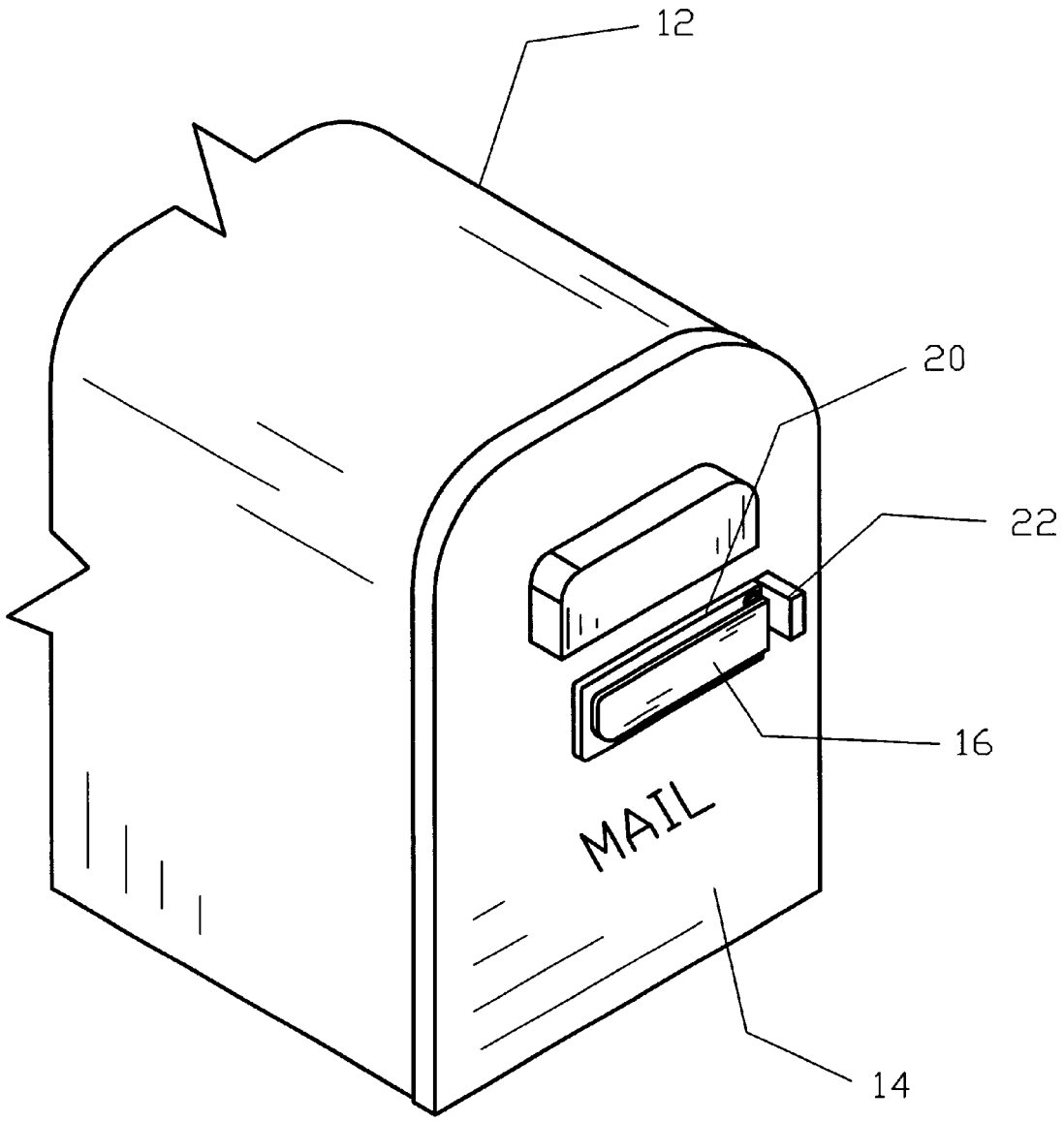
FIG. 10 is a close-up view of the base plate having a stop thereon.
Figure 11:
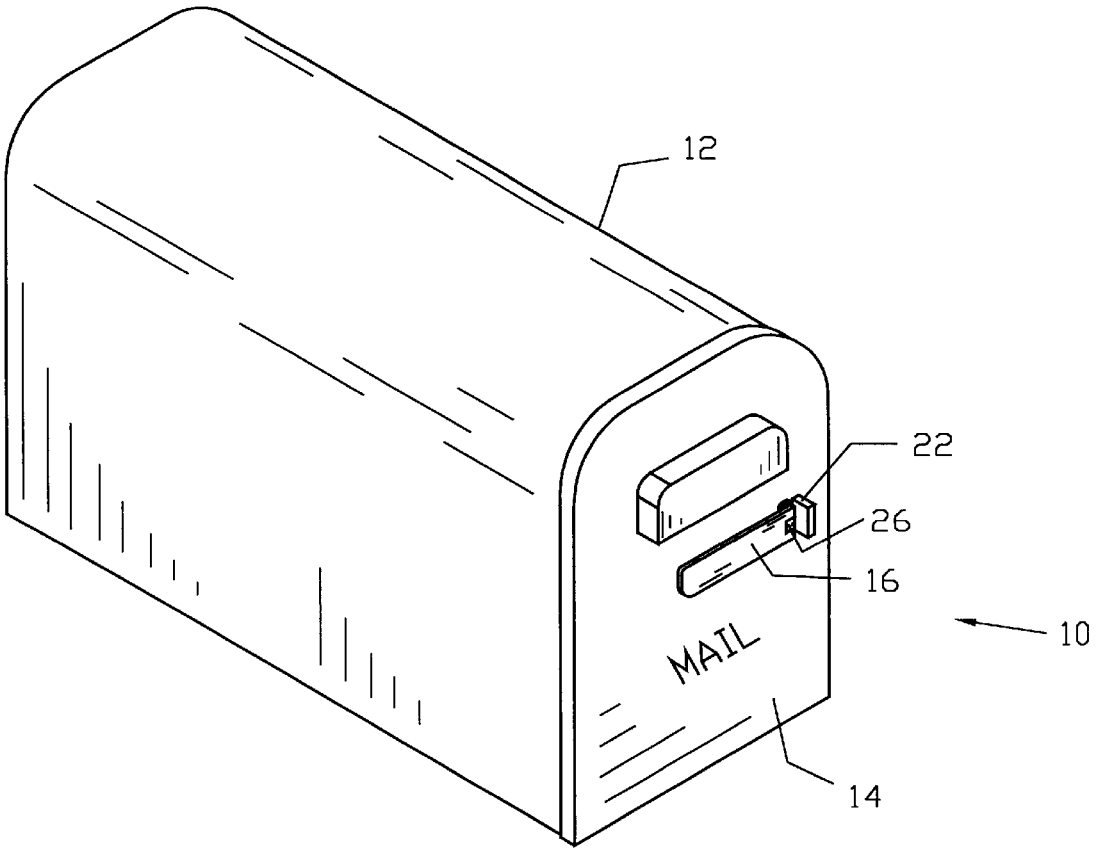
FIG. 11 is a perspective view of the receptacle with indicator flag with a magnet located on the flag member.
Figure 12:
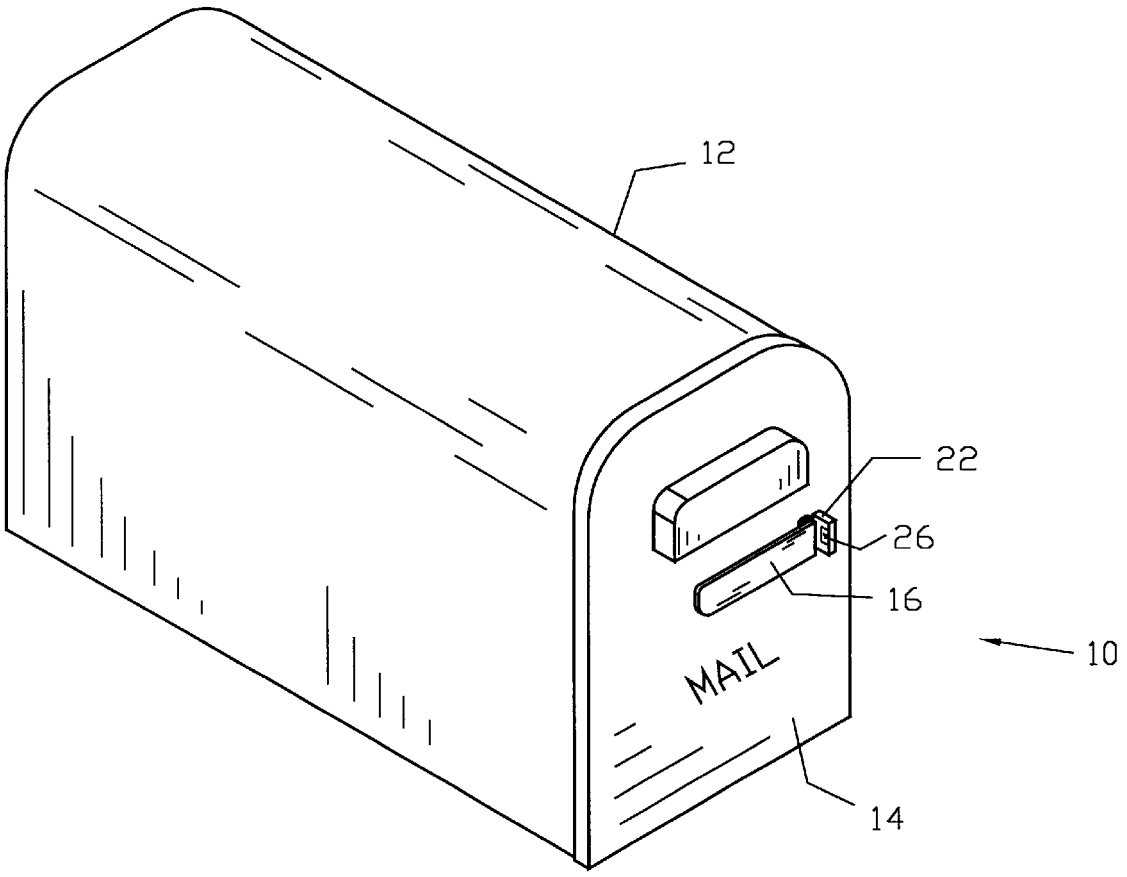
FIG. 12 is a perspective view of the receptacle with indicator flag with a magnet located on the stop.

Referring now to the drawings, it is seen that the mailbox indicator flag of the present invention, generally denoted by reference numeral 10, is comprised of a typical mailbox 12 which is a body member with a hollow interior, with a door 14 attached to the mailbox 12 for gaining access to the hollow interior. The mailbox 12 is attached to the ground G in typical fashion such as by way of a pole P. A generally horizontally disposed flag member 16 is rotatably attached to the door 14 and is capable of rotating between a first position wherein the flag member 16 is generally flush against the door 14 and a second position wherein the flag member 16 extends outwardly from the door 14 and is disposed generally normal to the door 14. The flag member 16 may be of any appropriate color and ideally will be of an attention capturing color such as red, orange, yellow, etc. The flag member 16 is attached to the door 14 by any appropriate hinging element 18 (the term hinging element being broadly defined to include any appropriate device that allows rotation of the flag member 16) such as a limit hinge, and the hinging element will have sufficient frictional rotation resistance so that when the flag member 16 is rotated to the second position, the flag member 16 will remain in the second position even if subject to a moderate wind load. If a limit hinge is used, it may be spring-loaded. If a spring-loaded limit hinge is used, if a person, such as a bicycle rider hits the flag while traveling, which hit will cause the flag member 16 to rotate beyond the second position, the spring-loaded nature of the limit hinge will allow the flag member 16 to rotate some distance beyond the second position so as to minimize or eliminate injury to the traveler and thereafter to return to the second position. The flag member 16 may be attached directly to the door 14 and it may be attached to the door 14 via a base plate 20, with the flag member 16 and its associated hinging element 18 attached to the base plate 20 and the base plate 20 attached to the door 14 in any appropriate fashion. This arrangement may be easier in certain retrofit settings.

A stop 22 may be used to prevent overrotation of the flag member 16. The stop 22 may be attached to the door 14, to the hinging element 18, or to the base plate 20, if used. If the stop 22 is attached to the base plate 20, it may be similar to the physical barrier type stop 22 that is attached to the door, (as seen in FIG. 1), or the stop may be configured such that a portion of the inner face of the flag member 16 (the face that faces the door 14 when the flag member 16 is in the first position) abuts against an end of the base plate 20 or a portion of the hinging element 18 in order to form the limit of rotational motion and thus the stop 22.

If desired, the flag member 16 may be capable of rotating to a third position such that when the flag member 16 is in the third position, it is located on a plane that is the generally the same plane that the flag member 16 lies on whenever it is in the first position. The flag member 16 may be rotated to this third position by the mail carrier to signify to the mailbox 12 owner that mail has been delivered for the day.

The entire invention may comprise a flag member 16 that is attached to the door 14 of an existing mailbox and be a raised portion thereof. As one alternative, the door 14 may be customized such that an indented portion 24 is disposed on the door 14, the indented portion 24 receiving the flag member 16 whenever the flag member 16 is in the first position.

A magnet 26 may be attached to either the flag member 16 or the door 14 for holding the flag member 16 against the door 14 whenever the flag member 16 is in the first position. If the flag member 16 holds the magnet 26 and the door 14 is made from a nonmagnetic material (a material that does not magnetically couple to a magnet), then a magnetically sensitive portion 28 will be attached to a corresponding point on the door 14 for magnetically coupling to the magnet 26 on the flag member 16, or alternately, if the door 14 holds the magnet 26 and the flag member 16 is made from a nonmagnetic material, then a magnetically sensitive portion 28 will be attached to the flag member 16 for magnetically coupling to the magnet 26 on the flag member 16.

Similarly, a magnet 26 may be attached to either the flag member 16 proximate the hinging element 18 or the stop 22 (in any configuration of the stop 22 as described above) for holding the flag member 16 against the stop 22 whenever the flag member 16 is in the second position. If the flag member 16 holds the magnet 26 and the stop 22 is made from a nonmagnetic material, then a magnetically sensitive portion 28 will be attached to the stop 22 for magnetically coupling to the magnet 26 on the flag member 16, or alternately, if the stop 22 holds the magnet 26 and the flag member 16 is made from a nonmagnetic material, then a magnetically sensitive portion 28 will be attached to the flag member 16 for magnetically coupling to the magnet 26 on the flag member 16.

While the invention has been particularly shown and described with reference to an embodiment thereof, it will be appreciated by those skilled in the art that various changes in form and detail may be made without departing from the spirit and scope of the invention.

I claim:

1. A receptacle with an indicator flag comprising:

a mailbox having a hollow interior;

a door pivotally attached to the mailbox for gaining access to the interior, the door pivotable about a first axis; and a flag member attached to the door and capable of extending between a first position wherein the flag member is generally flush against the door and a second position wherein the flag member extends outwardly from the door, the flag pivotable about a second axis that is perpendicular relative to the first axis.

2. The receptacle with an indicator flag as in claim 1 wherein the flag member is hingedly attached to the door such that the flag member rotates about a generally vertical axis.

3. The receptacle with an indicator flag as in claim 1 wherein the flag member is attached to the door by a limit hinge.

4. The receptacle with an indicator flag as in claim 3 wherein the limit hinge is spring-loaded.

5. The receptacle with an indicator flag as in claim 1 wherein the flag member is generally horizontally disposed.

6. The receptacle with an indicator flag as in claim 1 wherein the flag member is located on a plane whenever the flag member is in the first position and wherein the flag member is capable of extending to a third position such that in the third position the flag member is located on the plane.

7. The receptacle with an indicator flag as in claim 1 further comprising an indented portion disposed on the door, the indented portion receiving the flag member whenever the flag member is in the first position.

8. The receptacle with an indicator flag as in claim 1 further comprising a magnet attached to the flag member for magnetically coupling the flag member with the door whenever the flag member is in the first position.

9. The receptacle with an indicator flag as in claim 1 further comprising a magnet attached to the door for magnetically coupling the door with the flag member whenever the flag member is in the first position.

10. The receptacle with an indicator flag as in claim 1 further comprising a stop attached to the door for preventing further extension of the flag member beyond the second position.

11. The receptacle with an indicator flag as in claim 10 further comprising a magnet attached to the flag member for magnetically coupling the flag member with the stop whenever the flag member is in the second position.

12. The receptacle with an indicator flag as in claim 10 further comprising a magnet attached to the stop for magnetically coupling the stop with the flag member whenever the flag member is in the second position.

13. The receptacle with an indicator flag as in claim 1 further comprising a base plate attached to the door with the flag member attached to the base plate, and the base plate being flush against the door and the flag being flush against the base plate when in the first position.

14. The receptacle with an indicator flag as in claim 13 further comprising a magnet attached to the flag member for magnetically coupling the flag member with the base plate whenever the flag member is in the first position.

15. The receptacle with an indicator flag as in claim 13 further comprising a magnet attached to the base plate for magnetically coupling the base plate with the flag member whenever the flag member is in the first position.

16. The receptacle with an indicator flag as in claim 13 further comprising a stop attached to the base plate for preventing further extension of the flag member beyond the second position.

17. The receptacle with an indicator flag as in claim 16 further comprising a magnet attached to the flag member for magnetically coupling the flag member with the stop whenever the flag member is in the second position.

18. The receptacle with an indicator flag as in claim 16 further comprising a magnet attached to the stop for magnetically coupling the stop with the flag member whenever the flag member is in the second position.

19. A receptacle with an indicator flag comprising:

a mailbox having a hollow interior;

a door pivotally attached to the mailbox for gaining access to the interior, the door pivotable about a first axis; and a generally horizontally disposed flag member attached to the door and capable of rotating between a first position wherein the flag member is generally flush against the door and a second position wherein the flag member extends outwardly from the door, the flag pivotable about a second axis that is perpendicular relative to the first axis.

20. The receptacle with an indicator flag as in claim 19 wherein the flag member is attached to the door by a limit hinge.

21. The receptacle with an indicator flag as in claim 20 wherein the limit hinge is spring-loaded.

22. The receptacle with an indicator flag as in claim 19 wherein the flag member is located on a plane whenever the flag member is in the first position and wherein the flag member is capable of extending to a third position such that in the third position the flag member is located on the plane.

23. The receptacle with an indicator flag as in claim 19 further comprising an indented portion disposed on the door, the indented portion receiving the flag member whenever the flag member is in the first position.

24. The receptacle with an indicator flag as in claim 19 further comprising a magnet attached to the flag member for magnetically coupling the flag member with the door whenever the flag member is in the first position.

25. The receptacle with an indicator flag as in claim 19 further comprising a magnet attached to the door for magnetically coupling the door with the flag member whenever the flag member is in the first position.

26. The receptacle with an indicator flag as in claim 19 further comprising a stop attached to the door for preventing further extension of the flag member beyond the second position.

27. The receptacle with an indicator flag as in claim 26 further comprising a magnet attached to the flag member for magnetically coupling the flag member with the stop whenever the flag member is in the second position.

28. The receptacle with an indicator flag as in claim 26 further comprising a magnet attached to the stop for magnetically coupling the stop with the flag member whenever the flag member is in the second position.

29. The receptacle with an indicator flag as in claim 19 further comprising a base plate attached to the door with the flag member attached to the base plate, and the base plate being flush against the door and the flag being flush against the base plate when in the first position.

30. The receptacle with an indicator flag as in claim 29 further comprising a magnet attached to the flag member for magnetically coupling the flag member with the base plate whenever the flag member is in the first position.

31. The receptacle with an indicator flag as in claim 29 further comprising a magnet attached to the base plate for magnetically coupling the base plate with the flag member whenever the flag member is in the first position.

32. The receptacle with an indicator flag as in claim 29 further comprising a stop attached to the base plate for preventing further extension of the flag member beyond the second position.

33. The receptacle with an indicator flag as in claim 32 further comprising a magnet attached to the flag member for magnetically coupling the flag member with the stop whenever the flag member is in the second position.

34. The receptacle with an indicator flag as in claim 32 further comprising a magnet attached to the stop for magnetically coupling the stop with the flag member whenever the flag member is in the second position.

35. An indicator flag attached to a door of a mailbox, the mailbox comprising a body member having a hollow interior and the door pivotally attached to the body member for gaining access to the interior, the door pivotable about a first axis, the indicator flag comprising a generally horizontally disposed flag member, having a proximal end adapted to be rotatably attached to the door and a distal end, the flag member capable of rotating between a first position wherein the flag member is generally flush against the door and a second position wherein the flag member extends outwardly from the door, the flag pivotable about a second axis that is perpendicular relative to the first axis.

36. The indicator flag as in claim 35 wherein the flag member is attached to the door by a limit hinge.

37. The indicator flag as in claim 36 wherein the limit hinge is spring-loaded.

38. The indicator flag as in claim 35 wherein the flag member is located on a plane whenever the flag member is in the first position and wherein the flag member is capable of extending to a third position such that in the third position the flag member is located on the plane.

39. The receptacle with an indicator flag as in claim 35 further comprising a magnet attached to the flag member for magnetically coupling the flag member with the door whenever the flag member is in the first position.

40. The receptacle with an indicator flag as in claim 35 further comprising a magnet attached to the door for magnetically coupling the door with the flag member whenever the flag member is in the first position.

41. The receptacle with an indicator flag as in claim 35 further comprising a stop attached to the door for preventing further extension of the flag member beyond the second position.

42. The receptacle with an indicator flag as in claim 41 further comprising a magnet attached to the flag member for magnetically coupling the flag member with the stop whenever the flag member is in the second position.

43. The receptacle with an indicator flag as in claim 41 further comprising a magnet attached to the stop for magnetically coupling the stop with the flag member whenever the flag member is in the second position.

44. The receptacle with an indicator flag as in claim 35 further comprising a base plate attached to the door with the flag member attached to the base plate, and the base plate being flush against the door and the flag being flush against the base plate when in the first position.

45. The receptacle with an indicator flag as in claim 44 further comprising a magnet attached to the flag member for magnetically coupling the flag member with the base plate whenever the flag member is in the first position.

46. The receptacle with an indicator flag as in claim 44 further comprising a magnet attached to the base plate for magnetically coupling the base plate with the flag member whenever the flag member is in the first position.

47. The receptacle with an indicator flag as in claim 44 further comprising a stop attached to the base plate for preventing further extension of the flag member beyond the second position.

48. The receptacle with an indicator flag as in claim 47 further comprising a magnet attached to the flag member for magnetically coupling the flag member with the stop whenever the flag member is in the second position.

49. The receptacle with an indicator flag as in claim 47 further comprising a magnet attached to the stop for magnetically coupling the stop with the flag member whenever the flag member is in the second position.

* * * * *